US005284296A

United States Patent [19]

Connors et al.

[11] Patent Number: 5,284,296

[45] Date of Patent: Feb. 8, 1994

[54] SYSTEM FOR SPRAYING CERAMIC SLURRIES ONTO SURFACES IN CONTACT WITH MOLTEN METALS

[75] Inventors: Timothy L. Connors, Chicago; Mohammed Ismail, Wheaton; Madjid Soofi, St. Charles, all of Ill.

[73] Assignee: Magneco/Metrel, Inc., Addison, Ill.

[21] Appl. No.: 805,513

[22] Filed: Dec. 12, 1991

[51] Int. Cl.[5] ..... B05B 7/04

[52] U.S. Cl. ..... 239/10; 239/142; 239/214.25; 239/310; 239/398; 366/132; 366/151

[58] Field of Search ..... 239/65, 101, 142, 214.25, 239/218.5, 222, 310, 398, 102.1; 366/151, 132, 17

[56] References Cited

U.S. PATENT DOCUMENTS

| | | | |
|---|---|---|---|
| 1,323,663 | 12/1919 | Weber | 239/142 |
| 2,073,779 | 3/1937 | Bramsen | 239/142 |
| 2,776,860 | 1/1957 | Griffis | 239/65 |
| 2,979,075 | 4/1961 | Hartley et al. | 239/310 |
| 3,101,902 | 8/1963 | Chamberlain et al. | 239/310 |
| 3,203,631 | 8/1965 | Jutila | 239/142 |
| 3,286,995 | 11/1966 | Burklo | 239/142 |
| 3,608,869 | 9/1971 | Woodle | 366/132 |
| 3,970,288 | 7/1976 | Brooks | 366/151 |
| 4,117,547 | 9/1978 | Mathis et al. | 366/17 |
| 4,214,859 | 7/1980 | Anders | 366/151 |
| 4,247,272 | 1/1981 | Anders | 366/151 |
| 4,397,561 | 8/1983 | Strong et al. | 366/151 |
| 4,523,854 | 6/1985 | Beckley | 366/132 |
| 4,823,987 | 4/1989 | Switall | 366/132 |

FOREIGN PATENT DOCUMENTS

| | | | |
|---|---|---|---|
| 696349 | 10/1964 | Canada | 239/142 |
| 1196002 | 7/1965 | Fed. Rep. of Germany | 239/65 |
| 2945361 | 5/1981 | Fed. Rep. of Germany | 366/151 |
| 448880 | 11/1974 | U.S.S.R. | 239/102.1 |
| 1258391 | 12/1971 | United Kingdom | 239/142 |

OTHER PUBLICATIONS

Tommy Gun Plastering Machines, Putzmeister, Inc. Mar. 1980. pp. 1-12.

*Primary Examiner*—Andres Kashnikow
*Assistant Examiner*—Lesley D. Morris
*Attorney, Agent, or Firm*—Willian Brinks Hofer Gilson & Lione

[57] ABSTRACT

A system for spraying ceramic coatings on surfaces in contact with molten metals in which a constant amount of slurry made from water and ceramic powder is supplied to a pump and a hose for applying the slurry to the surface to be coated. Activation of an air valve delivers air to the hose at a sufficient pressure to spray the slurry on the surface to be coated. Deactivation of the air valve shuts off the pump.

21 Claims, 3 Drawing Sheets

SYSTEM FOR SPRAYING CERAMIC SLURRIES ONTO SURFACES IN CONTACT WITH MOLTEN METALS

In the extraction of metals from its ores, molten metals, such as steel, come in contact with a variety of ceramic surfaces which tend to wear out. These surfaces often are repaired, applied or reapplied by the spraying of ceramic slurries which are of mortar like consistency. Until the present invention the application of ceramic slurries by spraying techniques has been done by an operator using crude compressed air spraying systems. In most instances it has been the responsibility of the operator to manually operate the systems by manipulating a number of valves and switches to apply the ceramic slurries.

Due to variations in water and air pressure as well as the level of the raw materials in storage bins the ability to estimate the relative proportions of water and ceramic powder to prepare a good slurry as well as the quantity of air required to effectively spray a given batch of slurry has been a trial and error procedure. These variables tend to produce non-uniform coatings. Further, these prior art systems require excessive down time.

The present invention provides a simple automatic system for spraying ceramic linings over surfaces which contact molten metals. In the automatic mode the operator is able to operate the system merely by adjusting an air valve located on the nozzle which is used to spray the ceramic slurries. The invention also has provision for a manual mode.

In a preferred embodiment of the invention, the system is a compact unit which is skid mounted. It is composed of a number of simple integrated parts that individually are available from standard commercial supply sources, thus making the assembly of manufacture of these systems simple and economical. In its broadest aspect the components of this system comprise the following units:

A. Pressure and volume regulators for regulating the pressure and volume of a source of water;

B. A ceramic powder storage hopper;

C. A mixer for mixing the pressure and volume regulated source of water and the ceramic powder to form a ceramic slurry;

D. A pump hopper containing a level sensor for detecting and controlling the level of slurry in the hopper which is delivered to the hopper from the mixer;

E. A constant flow slurry pump which receives slurry from the pump hopper;

F. A hose for delivering slurry from the slurry pump to a nozzle assembly which comprises a nozzle which is adapted to receive a source of compressed air and a valve for adjusting the volume of compressed air;

G. A switch activated in response to the opening or closing of the compressed air valve.

In preferred embodiments of the invention the system also contains an electrical control box for distributing electricity to the system. The control box is fitted with a variety of switches for manual operation in case such operation is desired and for activating or shutting down the system for routine maintenance and repair.

A skid mounted assembly which houses all of the main components is a particularly useful feature of the invention. A constant flow slurry pump is positioned within a wheel mounted pump cart which rides upon a track. This wheel mounted pump cart allows for easy repair access to the pump to allow for maintenance, repair or replacement.

For a better understanding of the invention reference may be had to the:

THE DRAWINGS

SPECIFIC EMBODIMENTS OF THE INVENTION

Figure 1:
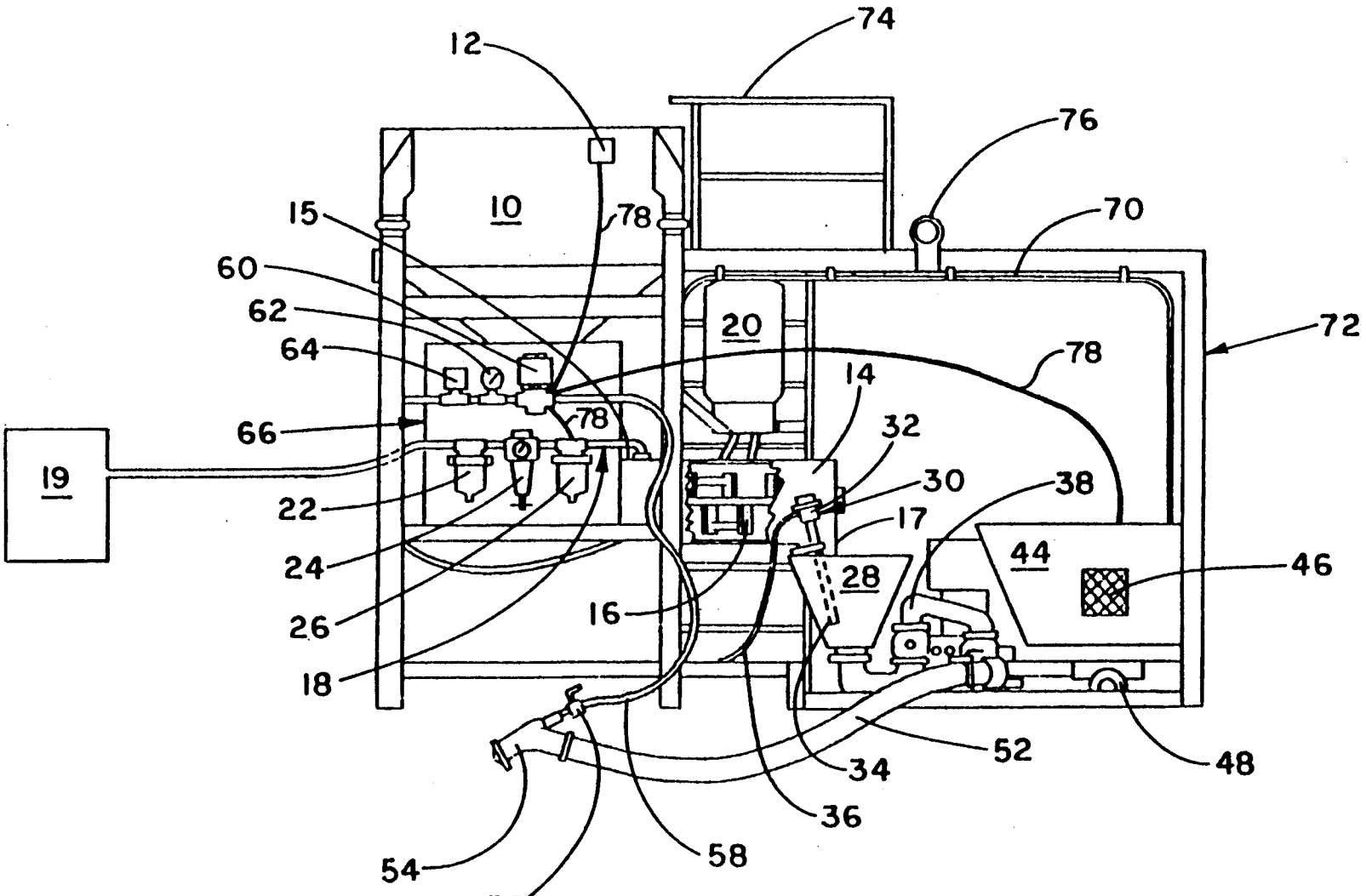
FIG. 1 is a side view showing the spray system of the invention.
Figure 2:
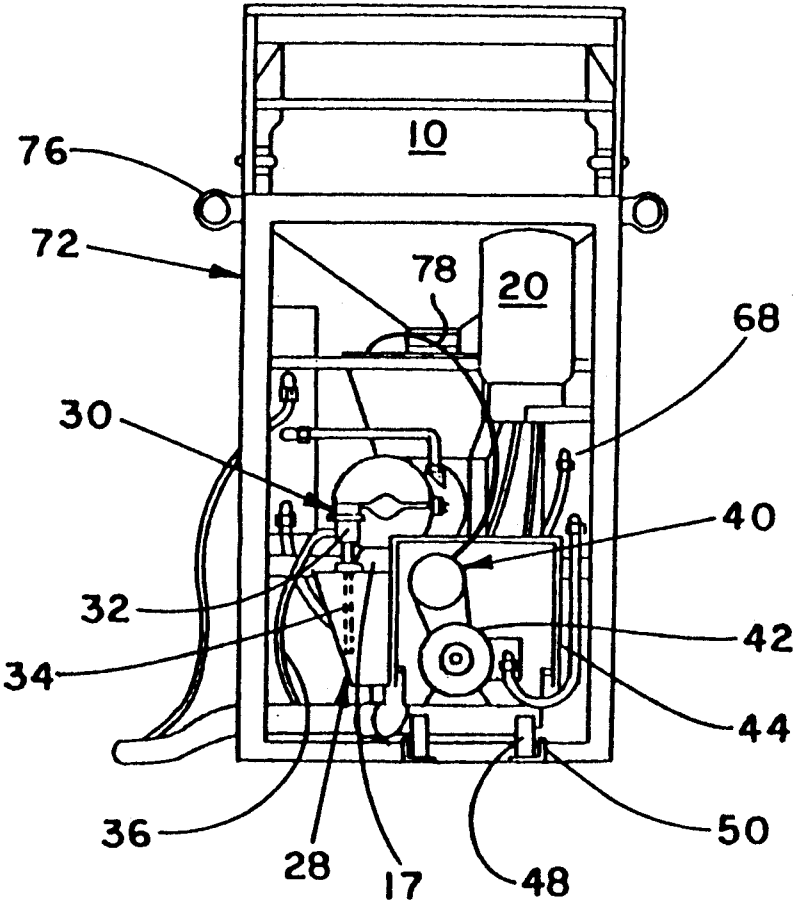
FIG. 2 is a back view of FIG. 1.

With particular reference to the drawings in which like parts have like numbers there is shown a ceramic powder storage hopper 10 which is fitted with an electrically driven vibrator 12. The vibrator allows the ceramic powder stored in the ceramic powder storage hopper to flow freely from the hopper and into the mixer 14. The mixer is horizontally disposed and may be considered to be of an auger type although it is fitted with a plurality of vanes 16 shown in the cut-away portion of the drawing which allows thorough mixing of the ceramic powder with water. The mixer 14 advances the slurry which is of mortar like consistency produced in the mixer from its inlet 15 into its outlet 17.

The mixer is supplied with water through water supply line 18. The water supply, prior to entering the mixer, enters from a source 19 through a pressure regulator 20 which preferably is a bladder tank. From the tank the water passes through optional filter 22 and then into flow control regulator 24. The water supply line 18 is further fitted with a solenoid shutoff valve 26. By providing both a pressure and volume regulation for the water supply it is possible to produce a slurry of good uniformity and consistency, within the mixer 14.

Slurry leaving the mixer feeds into a pump hopper 28 which is fitted with level sensor 30. This level sensor contains a level sensor head 32 which is a switch activated by sensor probe 34 located within pump hopper 28. The sensor probe 34 operates depending on whether or not the slurry contained in the hopper is at a low or high point therein. The level sensor connects to electrical line 36 which in turn provides power to the mixer 14 the vibrator 12 and the solenoid valve 26.

Slurry is transported by gravity and pump suction from the pump supply hopper 28 through line 38 into a positive displacement pump 40 which is belt driven by motor 42. The motor and pump are contained in what may be termed a pump cart designated generally by the numeral 44. The pump cart contains a ventilation screen 46 which also operates as a viewing port. The pump cart is further mounted on wheels 48 which ride on track 50. This feature allows the positive displacement pump 40 along with the motor 42 to be readily removed from the cart for inspection, repair and maintenance. The preferred pump assembly is sold by Putzmeister, Inc., Gardena, Cal. under the tradename of "Tommy Gun".

The discharge end of the pump is fitted with a slurry delivery hose 52 which terminates in spray nozzle 54. Associated with or mounted on the nozzle for easy operation by the operator applying the slurry is an air control valve 56 which receives a supply of compressed air typically at about 30 psi. The air supply line 58 enters the system and connects with a sail switch 60 and (optionally) pressure gauge 62. The air supply line 58 may also be fitted with a solenoid shutoff valve 64. The source of compressed air is not shown.

The various components used to regulate the air and water supplies with the exception of the pressure regulating tank 20 are located within a manifold box 66. The box has a twofold purpose; it keeps the switches and control devices free from dust and dirt, also, it makes servicing of these components simple since the box is normally mounted in a convenient location.

Supplying the system with a source of electricity is electrical control box 68 which acts as a distributor for the electrical needs of the system. Since the system is contemplated as being semi-portable, electricity is supplied to the control box through a conventional high voltage type connector. The control box is fitted with a number of switches, not shown, to facilitate the start up of the system as well as allowing shutdown of individual units which allows for emergency repair and maintenance operations to be conducted. The switches in the control box allow the system to be manually operated.

Figure 3:
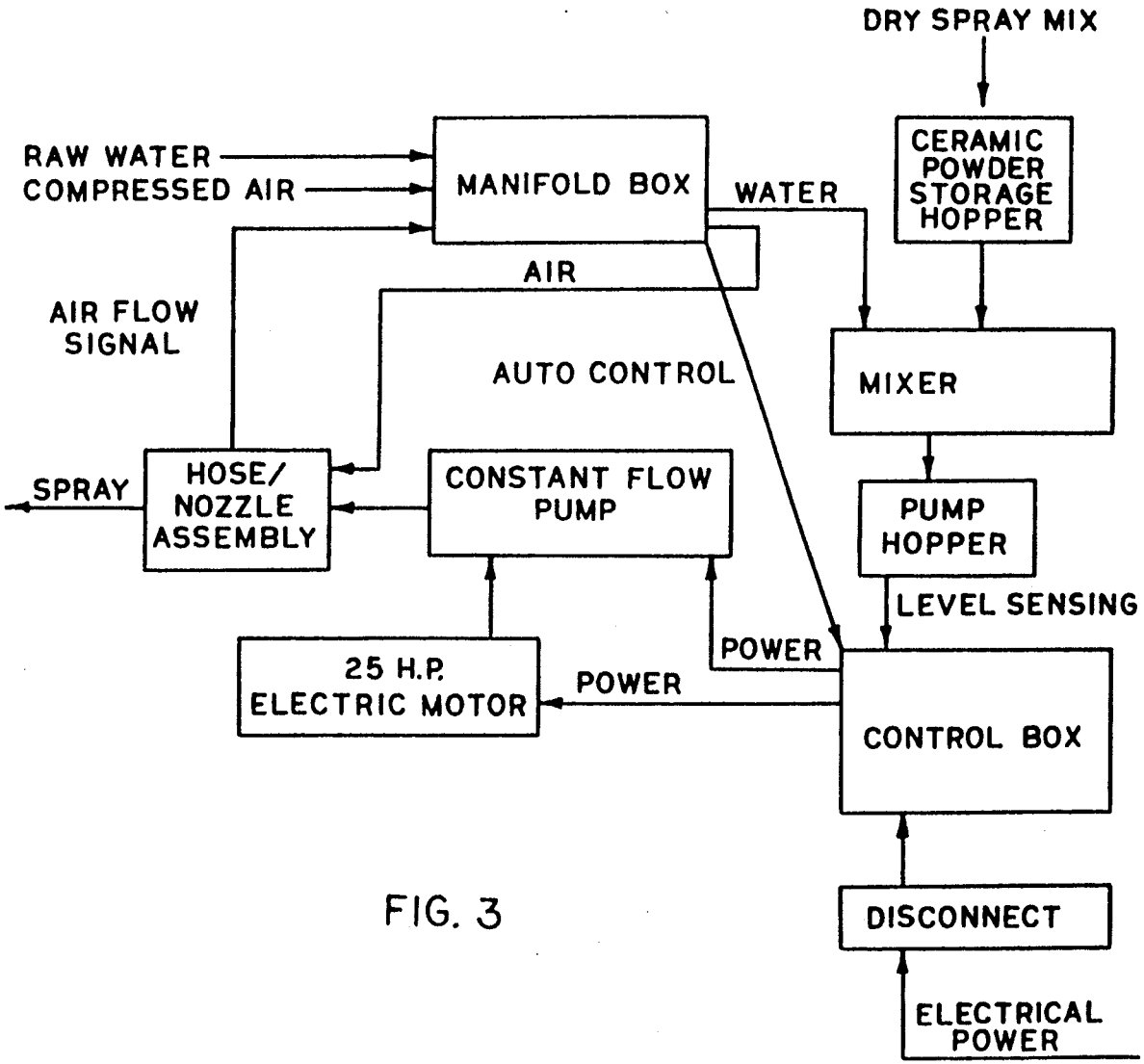
FIG. 3 is a schematic flow diagram showing the flow of water, air and ceramic powder through the system whereby these ingredients are combined and subsequently sprayed onto a surface which normally contacts molten metal.

The above description indicating how the system operates automatically to supply slurry to the nozzle for spraying onto surfaces normally in contact with molten metal may be further understood by reference to the flow chart shown in FIG. 3.

As indicated the system is designed to be semi-portable and is skid mounted within a steel framework usually made of angle iron which skid is designated generally by the numeral 72. The skid is fitted with a loading platform 74 for filling the supply hopper 10. It is also fitted with eyelets 76 which allow the entire unit to be moved by a crane to different locations.

The system is initially actuated by turning on the various switches operating the electrically actuated parts mounted on the skid 72. Prior to actuating the electrical and air systems the ceramic powder storage hopper is filled with ceramic powder of the type used to prepare slurries which are sprayed upon surfaces in contact with molten metals. Typically the ceramic powders are relatively fine having particles sizes below one quarter of an inch. Typically the particle size is in the micron size range.

With the vibrator 12 operating the powder slowly sifts through the ceramic powder storage hopper 10 and into the mixer 14. Water delivered through line 18 to the mixer and is blended with the powder into a slurry of mortar like consistency.

The slurry leaving the mixer empties into the pump hopper 28. It continues to fill the hopper until it reaches a high point on the probe 34 which turns the switch located in the level sensor head to the off position which by appropriate electrical lines is connected to the mixer 14 the vibrator 12 and the water supply line solenoid 26. This switch shuts these units off thereby depriving the mixer of water and ceramic powder to produce additional slurry. As the supply of slurry contained in the pump hopper 28 is fed into the positive displacement pump 40 and reaches a low level the switch in the sensor head 32 turns on the supply of water, actuates the vibrator 12 and turns on the mixer 14 thus allowing additional slurry to be produced. By using this sequence it is possible to continually assure that a constant amount of slurry is supplied to the pump 40 and from there to the pump delivery hose 52 for application of slurry to the surfaces being coated.

To begin spraying the slurry delivered from the pump to the nozzle the operator merely actuates the air pressure valve 56 which delivers air at sufficient pressure to produce a spray of slurry from the nozzle. As long as the operator keeps the air valve in the open position slurry is continuously delivered through the nozzle for application to the surface being coated.

When it is desired to shut off the system it is only necessary that the operator turn off the air valve 56 which turns off the sail switch 60. The sail switch is connected by an appropriate electrical line 78 to the pump 40, water solenoid 26 and optionally vibrator 12. Thus, by turning off the flow of air it is possible to shut down the pump and hence the delivery of slurry to the nozzle. Slurry from the mixer 14 continues to be added to the pump hopper 28 until it reaches a high level at which point it is shut off by the switch in sensor head 32, thereby shutting down the system completely. When the operator turns on the compressed air valve, the sail switch is turned on which starts the pump which again supplies mortar to the nozzle 54 for delivery to the surface sought to be coated.

While the above represents a preferred embodiment invention it is obvious to those skilled in the art that other shut down or shut off arrangements are possible. Thus, it is possible to shut down the system by wiring the sail switch to the mixer 10, vibrator 12 and water solenoid 26 so that the sail switch would operate all of the electrical systems utilized in the operation of the apparatus of the invention.

The convenience and advantage of the invention are readily apparent. In the first instance it is possible to have the entire system semi-portable. In the case of large steel mills where many different surfaces are subject to being coated over different periods of time it is possible by means of cranes which are readily available in such mills to move the system from place to place. Also, in such large mills since supplies of compressed air and high voltage electricity are available it is a simple matter to move the system and to have it operating in a short period of time to service any number of areas that need to be coated with ceramic coatings.

More important than the mobility of the system is the fact that constant monitoring of water, ceramic powder, slurry supply and the like need no longer concern the operator. The system in its fully automatic mode operates by the mere turning on and off of an air control valve which is conveniently located either in or near the slurry application nozzle. Finally, the system contains a number of features that allow for convenient servicing and maintenance particularly the pump cart assembly which allows ready removal of the pump for repair, cleaning and routine servicing.

We claim:

1. A method for spraying ceramic coatings on surfaces in contact with molten metals comprising the steps of:

providing water;

providing ceramic powder;

mixing the water and ceramic powder to produce a slurry;

directing said slurry to a pump;

delivering said slurry directed to said pump to a nozzle having a valve connected to a source of compressed air; and opening said valve so that said pump is turned on and said slurry is dispersed through said nozzle.

2. The method according to claim 1, comprising the step of closing said valve so that said pump is turned off.

3. A method for spraying ceramic coatings on surfaces in contact with molten metals comprising the steps of:

providing water;

providing ceramic powder;

mixing the water and ceramic powder to produce a slurry;

directing said slurry to a pump;

automatically detecting the amount of slurry directed to said pump; and delivering said slurry directed to said pump to a nozzle assembly.

4. The method according to claim 3, wherein the step of automatically detecting the amount of the slurry comprises determining whether or not said water is to be provided.

5. The method according to claim 3, wherein the step of automatically detecting the amount of the slurry comprises determining whether or not said ceramic powder is to be provided.

6. The method according to claim 6, wherein said slurry is directed to a pump hopper after the mixing step and the slurry directed to the pump hopper is then directed to a pump, wherein the step of automatically detecting the amount of slurry directed to said pump comprises detecting the level of said slurry in said pump hopper.

7. A system for spraying ceramic coatings on surfaces in contact with molten metals comprising:

a source of water;

a storage hopper for containing a ceramic powder;

a mixer connected to said source of water so as to receive water therefrom and connected to said storage hopper so as to receive ceramic powder therefrom, wherein said mixer mixes the received water and ceramic powder to produce a slurry;

a level sensor for detecting the amount of slurry produced by the mixer;

a pump connected to said mixer which receives slurry from said mixer;

a hose connected to said pump for delivering said slurry from said mixer received by said pump to a nozzle assembly.

8. The system according to claim 7, wherein said level sensor is connected to said water source so as to control whether or not water is supplied to said mixer from said water source.

9. The system according to claim 8, wherein said level sensor is connected to said storage hopper so as to control whether or not ceramic powder is supplied to said mixer from said storage hopper.

10. The system according to claim 7, wherein said level sensor is connected to said storage hopper so as to control whether or not ceramic powder is supplied to said mixer from said storage hopper.

11. A system for spraying ceramic coatings on surfaces in contact with molten metals comprising:

a source of water;

a storage hopper for containing a ceramic powder;

a mixer connected to said source of water so as to receive water therefrom and connected to said storage hopper so as to receive ceramic powder therefrom, wherein said mixer mixes the received water and ceramic powder to produce a slurry;

a level sensor for detecting the amount of slurry produced by the mixer;

a pump connected to said mixer which receives slurry from said mixer;

a pump hopper connected to said mixer to receive said slurry from said mixer and connected to said pump to provide said slurry to said pump, wherein said level sensor measures the amount of slurry in said pump hopper; and a hose connected to said pump for delivering said slurry from said mixer received by said pump to a nozzle assembly.

12. A system for spraying ceramic coatings on surfaces in contact with molten metals comprising:

a source of water;

a storage hopper for containing a ceramic powder;

a mixer connected to said source of water so as to receive water therefrom and connected to said storage hopper so as to receive ceramic powder therefrom, wherein said mixer mixes the received water and ceramic powder to produce a slurry;

a level sensor for detecting the amount of slurry produced by the mixer;

a pump connected to said mixer which receives slurry from said mixer, wherein said pump is wheel-mounted and rides on tracks; and a hose connected to said pump for delivering said slurry from said mixer received by said pump to a nozzle assembly.

13. A system for spraying ceramic coatings on surfaces in contact with molten metals comprising:

a source of water;

a storage hopper for containing a ceramic powder;

a mixer connected to said source of water so as to receive water therefrom and connected to said storage hopper so as to receive ceramic powder therefrom, wherein said mixer mixes the received water and ceramic powder to produce a slurry;

a pump connected to said mixer which receives said slurry from said mixer;

a hose connected to said pump for delivering said slurry from said mixer received by said pump to a nozzle assembly, wherein said nozzle assembly comprises:

1) a nozzle to disperse said slurry on said surface to be coated;

2) a valve connected to a source of compressed air such that when said valve is opened said slurry is dispersed through said nozzle; and 3) a switch connected to said valve and said pump, such that when said valve is closed said switch shuts said pump off.

14. The system according to claim 13, wherein said switch is connected to said valve and said mixer, such that when said valve is closed said switch shuts said mixer off.

15. The system according to claim 14, wherein when said valve is opened said switch turns said mixer on.

16. The system according to claim 13, wherein said switch is connected to said valve and said water supply, such that when said valve is closed said switch shuts said water supply off so that no water is received by said mixer.

17. The system according to claim 16, wherein when said valve is opened said switch turns said water supply on so that water is received by said mixer from said water supply.

18. The system according to claim 13, wherein when said valve is opened said switch turns said pump on.

19. The system according to claim 13, wherein said storage hopper comprises a vibrator.

20. The system according to claim 13, wherein said pump is wheel-mounted and rides on tracks.

21. A system for spraying ceramic coatings on surfaces in contact with molten metals comprising:

a source of water;

a storage hopper for containing a ceramic powder;

a mixer connected to said source of water so as to receive water therefrom and connected to said storage hopper so as to receive ceramic powder therefrom, wherein said mixer mixes the received water and ceramic powder to form a slurry;

a pump hopper connected to said mixer to receive said slurry from said mixer;

a level sensor for detecting and controlling the level of slurry in said pump hopper;

a pump connected to said pump hopper which receives slurry from said pump hopper;

a hose connected to said pump for delivering said slurry from said pump hopper received by said pump to a nozzle assembly, wherein said nozzle assembly comprises:

1) a nozzle to disperse said slurry on said surface to be coated;

2) a valve connected to a source of compressed air such that when said valve is opened said slurry is dispersed through said nozzle; and 3) a switch connected to said valve and said pump, such that when said valve is closed said switch shuts said pump off.

* * * * *

UNITED STATES PATENT AND TRADEMARK OFFICE

CERTIFICATE OF CORRECTION

PATENT NO. : 5,284,296
DATED : February 8, 1994
INVENTOR(S) : Timothy L. Connors et al.

It is certified that error appears in the above-indentified patent and that said Letters Patent is hereby corrected as shown below:

Column 5,

In Claim 6, line 1, delete "6" and insert --4-- therefor.

Signed and Sealed this

Sixteenth Day of August, 1994

Bruce Lehman

*Attest:*

BRUCE LEHMAN

*Attesting Officer*

*Commissioner of Patents and Trademarks*